US012025007B2

(12) United States Patent
Wang et al.

(10) Patent No.: US 12,025,007 B2
(45) Date of Patent: Jul. 2, 2024

(54) COAL UNCOVERING CONSTRUCTION METHOD FOR BLASTING LARGE CROSS-SECTION GAS TUNNELS

(71) Applicants: China Railway 16th Bureau Group Co., Ltd, Beijing (CN); China Railway Eryuan Engineering Group Co., Ltd, Chengdu (CN); Beijing Jiaotong University, Beijing (CN); China Railway 16th Bureau Group 1st Engineering Co., Ltd, Beijing (CN); China Railway 16th Bureau Group 4th Engineering Co., Ltd, Beijing (CN)

(72) Inventors: Wuxian Wang, Beijing (CN); Su Yan, Beijing (CN); Liang Kuang, Chengdu (CN); Jinwen Yang, Beijing (CN); Mingli Huang, Beijing (CN); Yitao Feng, Beijing (CN); Wanqiang Zhao, Chengdu (CN); Liujie Jin, Beijing (CN); Weiming Zhang, Beijing (CN); Qian Dong, Beijing (CN); Liang Du, Beijing (CN)

(73) Assignees: China Railway 16th Bureau Group Co., Lid, Beijing (CN); China Railway Eryuan Engineering Group Co, Eid, Chengdu (CN); Beijing Jiaotong University, Beijing (CN); China Railway 16th Bureau Group 1st Engineering Co., Ltd, Beijing (CN); China Railway 16th Bureau Group 4th Engineering Co., Ltd, Beijing (CN)

( * ) Notice: Subject to any disclaimer, the term of this patent is extended or adjusted under 35 U.S.C. 154(b) by 0 days.

(21) Appl. No.: 18/224,720

(22) Filed: Jul. 21, 2023

(65) Prior Publication Data

US 2024/0035380 A1 Feb. 1, 2024

(30) Foreign Application Priority Data

Jul. 26, 2022 (CN) ..... 202210887595.1

(51) Int. Cl.
*E21D 9/00* (2006.01)
*F42D 5/04* (2006.01)
*F42D 3/04* (2006.01)

(52) U.S. Cl.
CPC ..... *E21D 9/006* (2013.01); *F42D 5/04* (2013.01); *F42D 3/04* (2013.01)

(58) Field of Classification Search
CPC .... F42B 3/192; F42B 3/06; F42B 3/26; F42B 39/30; E21D 9/006; F42D 3/04; F42D 5/02; F42D 5/04; F42D 5/06; F42D 1/08
(Continued)

(56) References Cited

U.S. PATENT DOCUMENTS

2012/0282680 A1* 11/2012 Goodridge ..... F42D 5/04 435/262.5
2019/0368322 A1* 12/2019 Shahinpour ..... F42B 3/18

FOREIGN PATENT DOCUMENTS

CN 109236362 A * 1/2019 ..... E21C 41/18

OTHER PUBLICATIONS

English language machine translation of Chen et al., CN-109236362; published Jan. 18, 2019 (9 pages) (Year: 2019).*

* cited by examiner

*Primary Examiner* — Christopher J Sebesta
*Assistant Examiner* — Michael A Goodwin

(57) ABSTRACT

A coal uncovering construction method for blasting large cross-section gas tunnels includes: analyzing stress distribution characteristics in front of a tunnel boring working face, and then determining a thickness calculation model of a reserved rock wall based on a limit equilibrium theory;
(Continued)

establishing a tunnel model, simulating a construction condition and analyzing a construction result, and determining a thickness of the reserved rock wall; and fixing a detonator through a fixed sand ring, fitting the detonator with a construction hole by adjusting an adjustable protective plate, then embedding the detonator into a blast hole, and blasting the detonator for tunnel construction. Furthermore, an extension ring is fixed between the fixed sand ring and the adjustable protective plate.

10 Claims, 8 Drawing Sheets

(58) Field of Classification Search
USPC ..... 299/13
See application file for complete search history.

COAL UNCOVERING CONSTRUCTION METHOD FOR BLASTING LARGE CROSS-SECTION GAS TUNNELS

TECHNICAL FIELD

The disclosure relates to the field of tunnel construction technologies, particularly to a coal uncovering construction method for blasting large cross-section gas tunnels.

BACKGROUND

With comprehensive propulsion of traffic infrastructures, especially when high-speed railways cross mountains with a straight and large radius curve, their lines inevitably cross a large number of coal measure strata. There is a high risk of coal and gas outburst when a tunnel construction crosses the coal measure strata. A strong impact force accompanying the coal and gas outburst not only damages the tunnel structure and ventilation system, but may even lead to gas outburst, workers' suffocation, or tunnel explosion, seriously threatening tunnel construction safety.

Before coal uncovering of tunnels, a safety rock wall with a certain thickness should be reserved, thereby preventing the gas from leaking, and making it convenient to take anti-outburst measures. Reasonably reserving the safety rock wall with the certain thickness is a key parameter for coal uncovering construction safety in a gas outburst working area of large cross-section gas tunnels. If the thickness of the reserved rock wall is too small, it is difficult to resist ground stress and gas pressure to directly expose the coal measure strata, causing potential safety hazards such as the gas outburst. On the contrary, the construction progress is affected, and the coal uncovering operation is affected. Therefore, the disclosure provides a coal uncovering construction method for blasting large cross-section gas tunnels.

SUMMARY

The disclosure solves at least one technical problem presented in the related art, thereby making up the deficiencies in the related art.

A technical solution provided by the disclosure to solve the technical problem is as follows: a coal uncovering construction method for blasting large cross-section gas tunnels, including the following steps:

- step 1, analyzing stress distribution characteristics in front of a tunnel boring working face, and then determining a thickness calculation model of a reserved rock wall based on a limit equilibrium theory;
- step 2, establishing a tunnel model, simulating a construction condition and analyzing a construction result based on the tunnel model, and thereby determining a thickness of the reserved rock wall based on the thickness calculation model of the reserved rock wall and the tunnel model; and
- step 3, fixing a detonator through a fixed sand ring, fitting the detonator with a construction hole by adjusting an adjustable protective plate, then embedding the detonator into a blast hole, and blasting (i.e., exploding) the detonator for tunnel construction.

In the coal uncovering construction method for blasting large cross-section gas tunnels, the thickness calculation model of the reserved rock wall for uncovering coal in a gas outburst working area is established, and a stress state of a unit body in a limit equilibrium zone of the model is analyzed, thus a formula for calculating a critical rock wall size is derived to determine the thickness of the reserved rock wall, an effect of effectively shortening a construction period for penetrating coal measure strata can be achieved while tunnel boring safety can be ensured.

In an embodiment, an extension ring is fixed between the fixed sand ring and the adjustable protective plate, a bottom of the adjustable protective plate is rotatably connected with a support foot, a shape of an end of the support foot facing away from the adjustable protective plate is sharp, an inner side of the fixed sand ring is connected with a plurality of extrusion rods, the plurality of extrusion rods are distributed in an array, an end of each of the plurality of extrusion rods facing towards a center of the fixed sand ring is fixedly connected to an adhesive plate, and a side of the adhesive plate facing away from the extrusion rod is connected to a sponge mat. In the coal uncovering construction method for blasting large cross-section gas tunnels, after determining the thickness of the reserved rock wall, a worker needs to first place the detonator into the fixed sand ring, and then push the plurality of extrusion rods to drive the plurality of adhesive plates to move until the plurality of adhesive plates are attached to an outer surface of the detonator, thereby realizing a fixation of the detonator. At this time, the detonator is embedded into the blast hole excavated in advance, an angle of the support foot is adjusted to support the adjustable protective plate, thereby to support the detonator, ensuring that the detonator will not deviate after being embedded, thereby effectively ensuring the construction quality.

In an embodiment, an outer surface of each extrusion rod is provided with a plurality of arc-shaped blocks, exteriors of the plurality of arc-shaped blocks are slidably connected with a plurality of support elastic pieces, the plurality of support elastic pieces are connected with the fixed sand ring and are distributed in an array inside the fixed sand ring, and the plurality of arc-shaped blocks and the plurality of support elastic pieces are arc-shaped and each of the plurality arc-shaped blocks is matched with a corresponding one of the plurality of support elastic pieces. In the coal uncovering construction method for blasting large cross-section gas tunnels, the plurality of extrusion rods are extruded to drive the plurality of arc-shaped blocks sliding during installing the plurality of the extrusion rods; the plurality of arc-shaped blocks are in contact with the plurality of support elastic pieces during the sliding, thereby pushing the plurality of support elastic pieces to bend and deform until the plurality of arc-shaped blocks completely slides over the plurality of support elastic pieces, and after then, the plurality of support elastic pieces reset, thereby limiting the plurality of arc-shaped blocks, preventing the plurality of arc-shaped blocks from being reset. Therefore, after the above operation, the plurality of arc-shaped blocks can be effectively limited, and then the plurality of extrusion rods and the corresponding plurality of adhesive plates are limited, thereby preventing the detonator from sliding out from the inner side of the fixed sand ring after the installation of the detonator.

In an embodiment, the extrusion rod is provided with an explosion-proof housing therein, the explosion-proof housing is provided with an energizing magnet therein, a side of the energizing magnet facing towards the adhesive plate is provided with a counterweight block, the counterweight block is provided with a follow-up magnet therein; when the energizing magnet is energized, a magnetic property of the energizing magnet is the same as that of the follow-up magnet, a side of the counterweight block facing away from the energizing magnet is provided with a knocking needle, a side of the knocking needle facing away from the energizing magnet is provided with a glass housing, a bottom end of the explosion-proof housing defines a liquid discharging hole, and the extrusion rod and the adhesive plate are respectively provided with through holes matched with the liquid discharge hole. In the coal uncovering construction method for blasting large cross-section gas tunnels, under normal circumstances, the detonator will explode to detonate the rock and soil; however, some of the detonators will not explode due to internal faults, and these detonators are referred to as misfired detonators. Once the misfired detonators appear, it needs to be carefully treated, taking the worker's safety prominent. When some misfired detonators cannot be used again, it requires safely dismantling and destruction. At this time, the worker can remotely start up a switch signal of the energizing magnet, causing the energizing magnet to operate with electricity, thereby exerting repulsive force on the follow-up magnet, and then the counterweight block drives the knocking needle to move under the repulsive force until the knocking needle collides with the glass housing, thereafter breaking down the glass housing, so that corrosive liquid loaded within the glass housing can leak, the leaked corrosive liquid drips onto the outer surface of the detonator through the liquid discharging hole and the through holes, so that the detonator is corroded until gunpowder inside the detonator is soaked, thereby making the detonator thoroughly invalid. It should be noted that the entire corrosion process takes different time depending on the concentration of the corrosive liquid. The worker can only return to recycle the detonator in half an hour after the corrosion operation is completed, thereby making it convenient to automatically destroy the misfired detonators while ensuring the worker's safety.

In an embodiment, an exterior of the counterweight block is slidably connected with a limiting frame, the limiting frame is provided with elastic pieces therein disposed on two sides of the counterweight block, and the elastic pieces are configured to support the counterweight block. In the coal uncovering construction method for blasting large cross-section gas tunnels, after the detonator explodes normally, the fixed sand ring will be decomposed by an impact force of the explosion, and the plurality of extrusion rods will also break down under the action of the explosion. At this time, the explosion-proof housing will protect its internal structure from a damage caused by the impact force of the explosion; the elastic pieces support and limit the counterweight block to prevent it from colliding the glass housing during the explosion of the detonator. It should be noted that the repulsive force generated after starting up the energizing magnet should be sufficient to drive the counterweight block to deform the elastic pieces by pushing them, thereby achieving a cyclic use of the explosion-proof housing.

In an embodiment, an end of the limiting frame facing away from the energizing magnet is provided with a rubber ring, and a buffer sponge is disposed between an exterior of the glass housing and the explosion-proof housing. In the coal uncovering construction method for blasting large cross-section gas tunnels, the rubber ring and the buffer sponge can achieve spacing protection of the glass housing in the process of the explosion-proof housing rolling after the explosion of the detonator, thereby preventing the glass housing from being broken down or being in contact with the knocking needle.

In an embodiment, a side of the liquid discharge hole facing away from the buffer sponge is slidably connected with a magnetic closing block, a plurality of telescopic rods are fixed between the magnetic closing block and the explosion-proof housing, and a side of the magnetic closing block facing towards the buffer sponge is provided with a telescopic needle. In the coal uncovering construction method for blasting large cross-section gas tunnels, after the counterweight block drives the knocking needle to break the glass housing, the counterweight block will sink to the bottom of the glass housing. During the above process, the magnetic force of the follow-up magnet will act on the magnetic closing block, thereby driving the magnetic closing block to compress the telescopic rods and then push the telescopic needle to move. It should be noted that the telescopic needle is of telescopic type, and the telescopic needle will also protrude and come into contact with the glass housing under the action of the magnetic force, piercing the glass housing and causing the glass housing to break down, further ensuring the corrosive liquid flow normally during the misfired detonator destruction and improving the stability of misfired detonator destruction. It also should be noted that under normal conditions, the telescopic needle will not come into contact with the glass housing when the magnetic closing block fully compresses the telescopic rods.

In an embodiment, a side of the explosion-proof housing facing away from the adhesive plate is inserted with a hollow column, the hollow column is filled with a large amount of colored smoke and defines a plurality of exhaust vents, each of the plurality of exhaust vents is provided with a counterweight ball therein, an outer surface of the counterweight ball is provided with a plurality of puncture needles, a supporting elastic rod is fixed between the counterweight ball and the hollow column, two sides of the counterweight ball are provided with elastic films, and the extrusion rod defines a plurality of through holes, which are matched with the plurality of exhaust vents. In the coal uncovering construction method for blasting large cross-section gas tunnels, after the normal explosion of the detonator, structural components inside the explosion-proof housing are mostly intact and reusable due to the protection of the explosion-proof housing. Furthermore, during the explosion of the detonator, the impact force generated will cause the counterweight ball to drive the supporting elastic rod to shake back and forth, thereby driving the plurality of puncture needles to pierce the elastic films caused by the shaking process of the counterweight ball, and then the colored smoke stored inside the hollow column will escape after the elastic films are pierced, which can effectively position the explosion-proof housing and is convenient for recycling the explosion-proof housing after the explosion, and then reducing searching time for the worker.

In an embodiment, the hollow column is provided with a plurality of stirring balls therein, and each of the plurality of stirring balls is connected to the hollow column through a connecting elastic rope. In the coal uncovering construction method for blasting large cross-section gas tunnels, after the detonator explodes, each of the plurality of stirring balls inside the hollow column will pull the corresponding connecting elastic rope to bounce back and forth under an action of inertia force, thereby stirring the colored smoke inside the hollow column and preventing a precipitation of colored particles containing in the smoke from causing difficulties for the worker to find the explosion-proof housing.

In an embodiment, the adhesive plate is slidably connected with a pair of jacking rods therein, a side of each of the pair of jacking rods facing away from the sponge mat is provided with a powder storage bag, and a side of the powder storage bag facing away from a center of the adhesive plate is connected with a powder discharging pipe in a penetrating manner. In the coal uncovering construction method for blasting cross-section gas tunnels, during the installation of the detonator, the adhesive plate will drive the sponge mat to gradually fit with the outer surface of the detonator. In the above process, the pair of jacking rods will slide under an action of the outer surface of the detonator, thereafter to push and squeeze the powder storage bags, and then to push and squeeze to spray dry powder inside the powder storage bags. The sprayed dry powder drips onto the outer surface of the detonator to keep the detonator's outer surface dry, thereby preventing a damp environment in the rock and soil from affecting the explosion of the detonator.

Beneficial Effects of the Disclosure are as Follows:

1. According to the coal uncovering construction method for blasting the large cross-section gas tunnels, the reserved rock wall model for uncovering coal in a gas outburst working area is established, and the stress state of the unit body in the limit equilibrium zone of the model is analyzed, thus the formula for calculating the critical rock wall size is derived to determine the thickness of the reserved rock wall, the effect of effectively shortening the construction period for penetrating the coal measure strata can be achieved while tunnel boring safety can be ensured.
2. According to the coal uncovering construction method for blasting the large cross-section gas tunnels, the detonator is fixed through the fixed sand ring, the angle of the support foot is adjusted to support the adjustable protective plate, and then the detonator is supported, thereby ensuring that the detonator cannot deviate after being embedded, and effectively ensuring the construction quality.

BRIEF DESCRIPTION OF DRAWINGS

The disclosure will be further described below with reference to the attached drawings.

Figure 1:
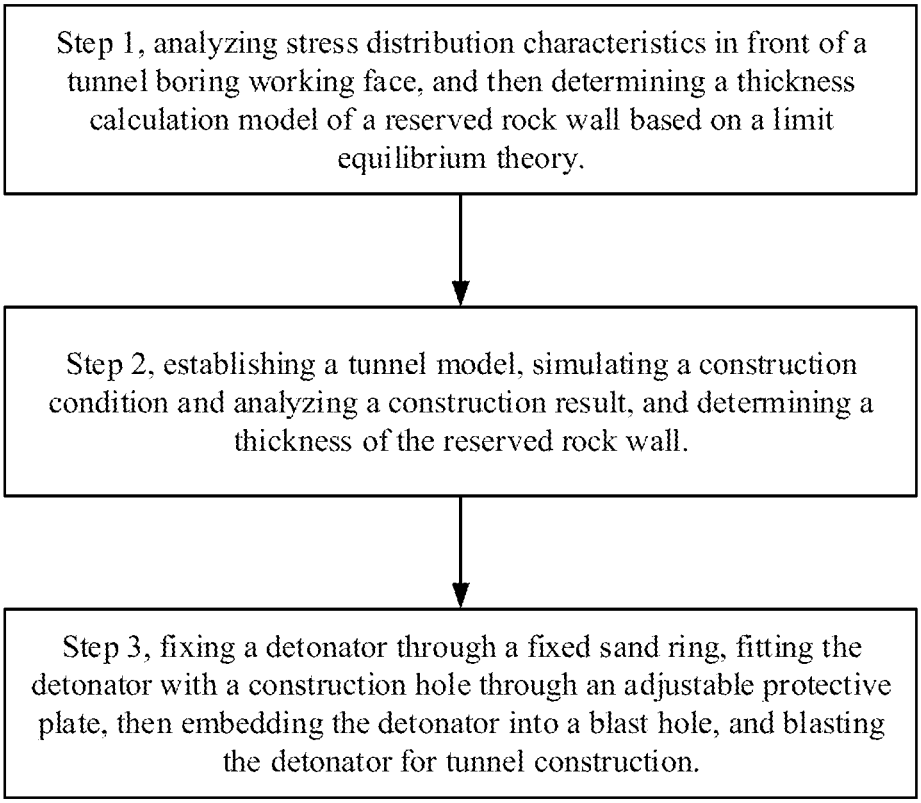
FIG. 1 illustrates a flowchart of a coal uncovering construction method for blasting large cross-section gas tunnels according to the disclosure.

In addition, please amend the paragraph [0028] of the specification as originally filed as follows.

DESCRIPTION OF REFERENCE NUMERALS

1—fixed sand ring; 2—extension ring; 3—adjustable protective plate; 4—support foot; 5—extrusion rod; 6—adhesive plate; 7—sponge mat; 8—arc-shaped block; 9—support elastic piece; 10—explosion-proof housing; 11—energizing magnet; 12—counterweight block; 13—follow-up magnet; 14—knocking needle; 15—elastic piece; 16—limiting frame; 17—rubber ring; 18—glass housing; 19—buffer sponge; 20—telescopic needle; 21—magnetic closing block; 22—telescopic rod; 23—hollow column; 24—counterweight ball; 25—puncture needle; 26—supporting elastic rod; 27—elastic film; 28—stirring ball; 29—connecting elastic rope; 30—jacking rod; 31—powder storage bag; 32—powder discharging pipe; 33—exhaust vent; 34—liquid discharging hole; 35—through hole; 36—through hole; 37—through hole; 38—detonator; 39—blast hole; 40—tunnel.

DETAILED DESCRIPTION OF EMBODIMENTS

In order to enable the technical solution, technical features, objectives and effects achieved by the disclosure to be easily understood, the disclosure is further described below in conjunction with illustrated embodiments.

Embodiment 1

As shown in FIG. 1, a coal uncovering construction method for blasting large cross-section gas tunnels according to an embodiment of the disclosure includes the following steps:

Step 1, stress distribution characteristics in front of a tunnel boring working face are analyzed, and then a thickness calculation model of a reserved rock wall is determined based on a limit equilibrium theory.

Step 2, a tunnel model is established, a construction condition is simulated and a construction result is analyzed based on the tunnel model, thus a thickness of the reserved rock wall is determined according to the thickness calculation model of the reserved rock wall and the tunnel model.

Step 3, a detonator is fixed through a fixed sand ring 1, the detonator is fitted with a construction hole by adjusting an adjustable protective plate 3, then the detonator is embedded into a blast hole, and the detonator is blasted for tunnel construction. In the coal uncovering construction method for blasting large cross-section gas tunnels, the thickness calculation model of the reserved rock wall for uncovering coal in a gas outburst working area is established, and a stress state of a unit body in a limit equilibrium zone of the model is analyzed, thus a formula for calculating a critical rock wall size is derived to determine the thickness of the reserved rock wall, an effect of effectively shortening a construction period for penetrating coal measure strata can be achieved while tunnel boring safety can be ensured.

Figure 2:
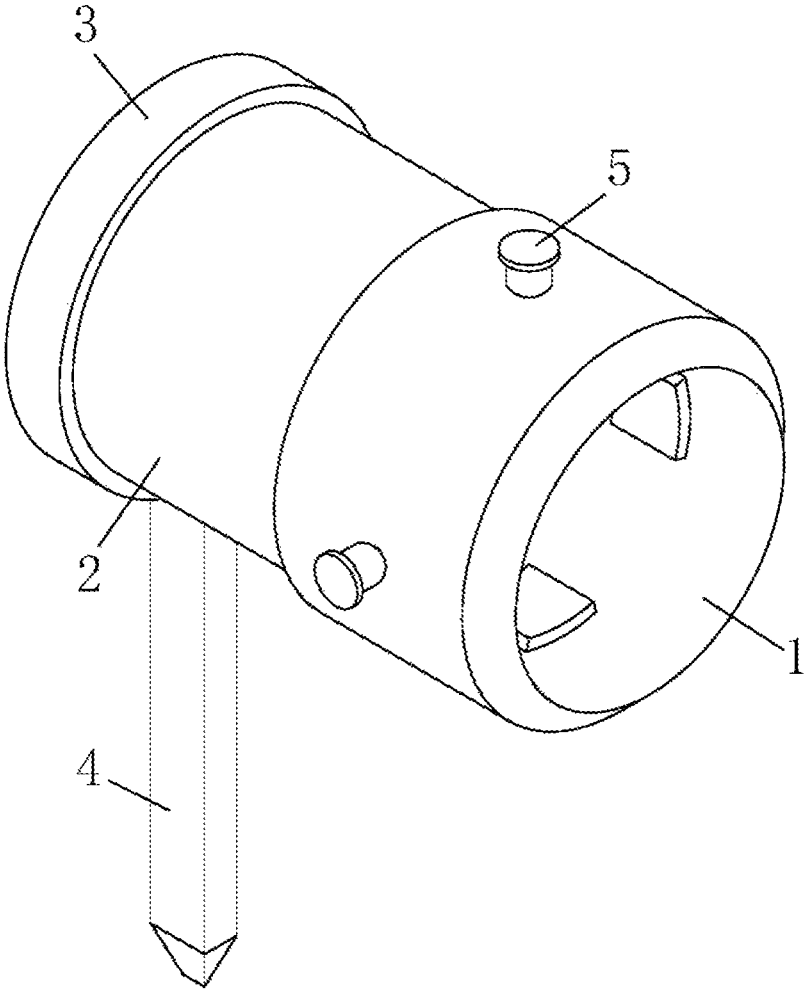
FIG. 2 illustrates a structural schematic stereogram of an extension ring according to the disclosure.
Figure 3:
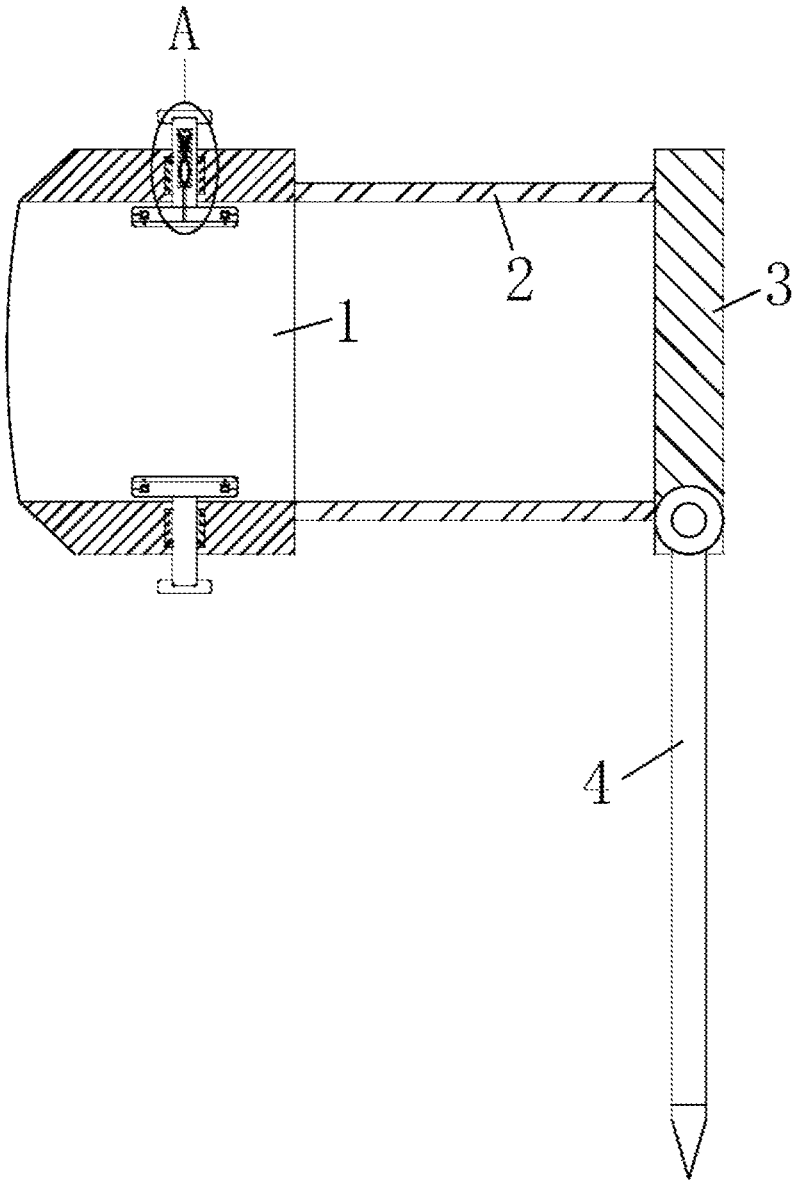
FIG. 3 illustrates a schematic section diagram of the extension ring of the disclosure.
Figure 4:
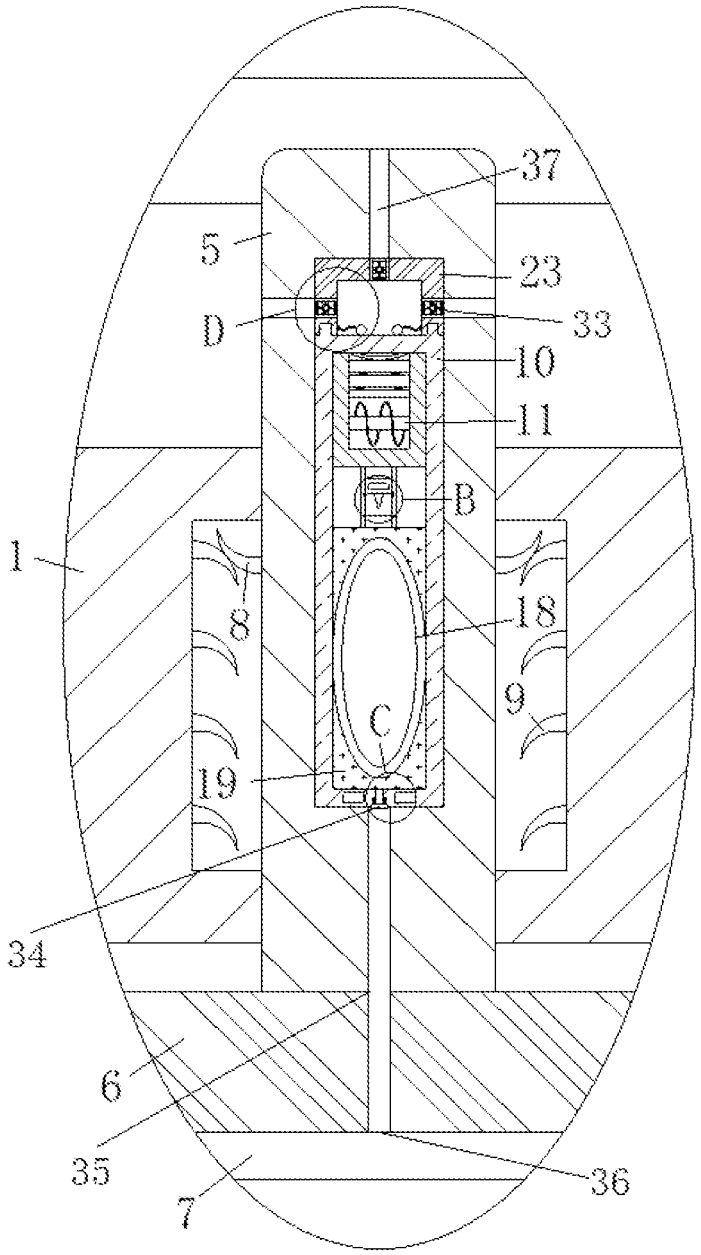
FIG. 4 illustrates a partial enlarged schematic diagram of an A portion in FIG. 3 according to the disclosure.

As shown in FIG. 2 to FIG. 4, an extension ring 2 is fixed between the fixed sand ring 1 and the adjusting protective plate 3, a bottom of the adjustable protective plate 3 is rotatably connected with a support foot 4, a shape of an end of the support foot 4 facing away from the adjustable protective plate 3 is sharp, an inner side of the fixed sand ring 1 is connected with a plurality of extrusion rods 5, the plurality of extrusion rods 5 are distributed in an array, an end of each of the plurality of extrusion rods 5 facing towards a center of the fixed sand ring 1 is fixedly connected to an adhesive plate 6 (i.e., a plurality of adhesive plates, each of which is corresponding to the extrusion rod), and a side of the adhesive plate 6 facing away from the extrusion rod 5 is fixedly connected to a sponge mat 7. In the coal uncovering construction method for blasting large cross-section gas tunnels, after determining the thickness of the reserved rock wall and then using the detonator for exploding, a worker needs to first place the detonator into the fixed sand ring 1, and then push the plurality of extrusion rods 5 to drive a plurality of corresponding adhesive plates 6 to move (i.e., each extrusion rod is attached to a corresponding adhesive plate) until the plurality of adhesive plates 6 are attached to an outer surface of the detonator, thereby realizing a fixation of the detonator. At this time, the detonator is embedded into the blast hole excavated in advance, an angle of the support foot 4 is adjusted to support the adjustable protective plate 3, thereby to support the detonator, ensuring that the detonator will not deviate after being embedded, thereby effectively ensuring the construction quality.

As shown in FIG. 4, an outer surface of each extrusion rod 5 is provided with a plurality of arc-shaped blocks 8, exteriors of the plurality of arc-shaped blocks 8 are slidably connected with a plurality of support elastic pieces 9, the plurality of support elastic pieces 9 are connected with the fixed sand ring 1 and are distributed in an array inside the fixed sand ring 1, and the plurality of arc-shaped blocks 8 and the plurality of support elastic pieces 9 are arc-shaped and each of the plurality of arc-shaped blocks 8 is matched with a corresponding one of the plurality of support elastic pieces 9. In the coal uncovering construction method for blasting large cross-section gas tunnels, the plurality of arc-shaped blocks 8 are driven to slide by pushing and extruding the plurality of extrusion rods 5 during installing the plurality of extrusion rods 5; the plurality of arc-shaped blocks 8 are in contact with the plurality of support elastic pieces 9 during the sliding, thereby pushing the plurality of support elastic pieces 9 to bend and deform until the plurality of arc-shaped blocks 8 completely slides over all of the plurality of support elastic pieces 9, and after then, the plurality of support elastic pieces 9 reset, thereby limiting the plurality of arc-shaped blocks 8, preventing the plurality of arc-shaped blocks 8 from being reset. Therefore, after the above operation, the plurality of arc-shaped blocks 8 can be effectively limited, and then the plurality of extrusion rods 5 and the corresponding adhesive plates 6 are limited, thereby preventing the detonator from sliding out from the inner side of the fixed sand ring 1 after the installation of the detonator.

Figure 5:
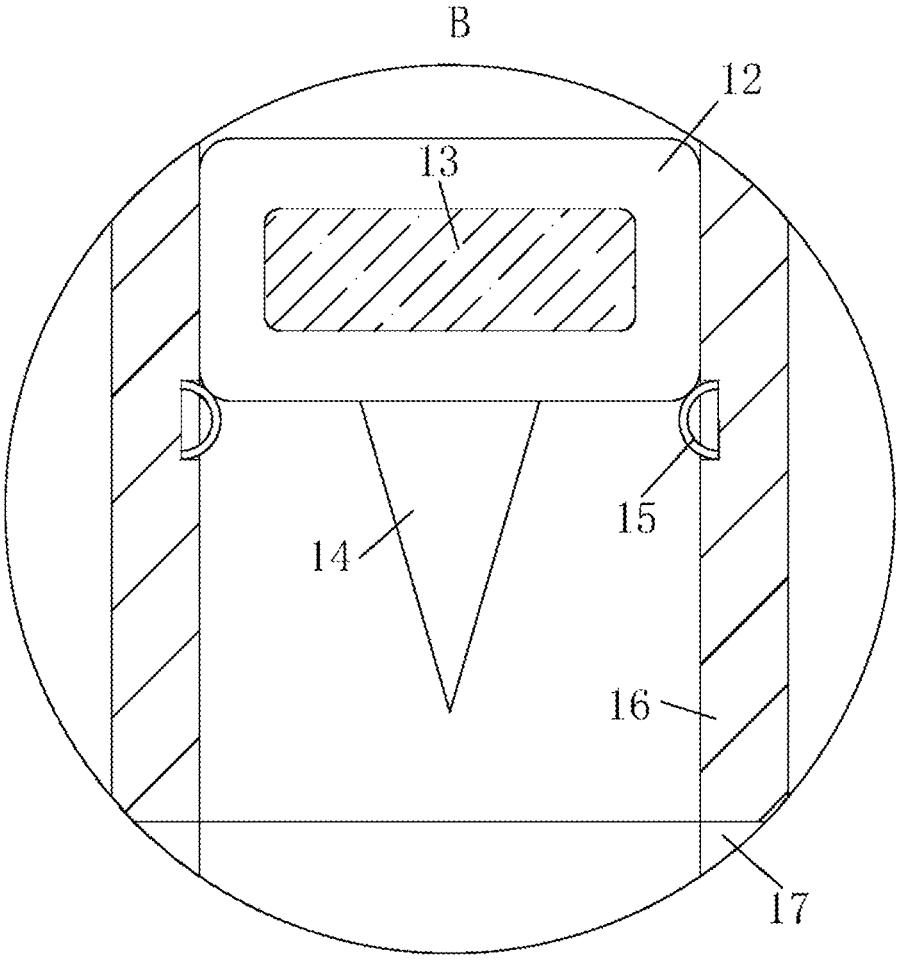
FIG. 5 illustrates a partial enlarged schematic diagram of a B portion in FIG. 4 according to the disclosure.

As shown in FIG. 4 to FIG. 5, the extrusion rod 5 is provided with an explosion-proof housing 10 therein, the explosion-proof housing 10 is provided with an energizing magnet 11, a side of the energizing magnet 11 facing towards the adhesive plate 6 is provided with a counterweight block 12, the counterweight block 12 is provided with a follow-up magnet 13 therein; when the energizing magnet 11 is energized, a magnetic property of the energizing magnet 11 is the same as that of the follow-up magnet 13, a side of the counterweight block 12 facing away from the energizing magnet 11 is provided with a knocking needle 14, a side of the knocking needle 14 facing away from the energizing magnet 11 is provided with a glass housing 18, a bottom end of the explosion-proof housing 10 defines a liquid discharging hole 34, and the corresponding extrusion rod 5 and the corresponding adhesive plate 6 are respectively provided with through holes (i.e., 35 and 36) matched with the liquid discharge hole 34. In the coal uncovering construction method for blasting large cross-section gas tunnels, under normal circumstances, the detonator will explode to detonate the rock and soil; however, some of the detonators will not explode due to internal faults, and these detonators are referred to as misfired detonators. Once the misfired detonators appear, it needs to be carefully treated, taking the worker's safety prominent. When some misfired detonators cannot be used again, it requires safely dismantling and destruction. At this time, the worker can remotely start up a switch signal of the energizing magnet 11, causing the energizing magnet 11 to operate with electricity, thereby exerting repulsive force on the follow-up magnet 13, and then the counterweight block 12 drives the knocking needle 14 to move under the repulsive force until the knocking needle 14 collides with the glass housing 18, thereafter breaking down the glass housing 18, so that corrosive liquid loaded within the glass housing 18 can leak, the leaked corrosive liquid drips onto the outer surface of the detonator through the liquid discharging hole 34, the through hole 35 disposed on a bottom end of the extrusion rod 5, and the through hole 36 disposed on the adhesive plate 6, so that the detonator is corroded until gunpowder inside the detonator is soaked, thereby making the detonator thoroughly invalid. It should be noted that the entire corrosion process takes different time depending on the concentration of the corrosive liquid. The worker can only return to recycle the detonator in half an hour after the corrosion operation is completed, thereby making it convenient to automatically destroy the misfired detonators while ensuring the worker's safety.

As shown in FIG. 5, an exterior of the counterweight block 12 is slidably connected with a limiting frame 16, the limiting frame 16 is provided with elastic pieces 15 therein disposed on two sides of the counterweight block 12, and the elastic pieces 15 are configured to support the counterweight block 12. In the coal uncovering construction method for blasting large cross-section gas tunnels, after the detonator explodes normally, the fixed sand ring 1 will be decomposed by an impact force of the explosion, and the plurality of extrusion rods 5 will also break down under the action of the explosion. At this time, the explosion-proof housing 10 will protect its internal structure from a damage caused by the impact force of the explosion; the elastic pieces 15 support and limit the counterweight block 12 to prevent it from colliding the glass housing 18 during the explosion of the detonator. It should be noted that the repulsive force generated after starting up the energizing magnet 11 should be sufficient to drive the counterweight block 12 to deform the elastic pieces 15 by pushing them, thereby achieving an effect of cyclic using the explosion-proof housing 10.

As shown in FIG. 4 to FIG. 5, an end of the limiting frame 16 facing away from the energizing magnet 11 is provided with a rubber ring 17, and a buffer sponge 19 is disposed between an exterior of the glass housing 18 and the explosion-proof housing 10. In the coal uncovering construction method for blasting large cross-section gas tunnels, the rubber ring 17 and the buffer sponge 19 can achieve spacing protection of the glass housing 18 in the process of the explosion-proof housing 10 rolling after the explosion of the detonator, thereby preventing the glass housing 18 from being broken down or being in contact with the knocking needle 14.

Figure 6:
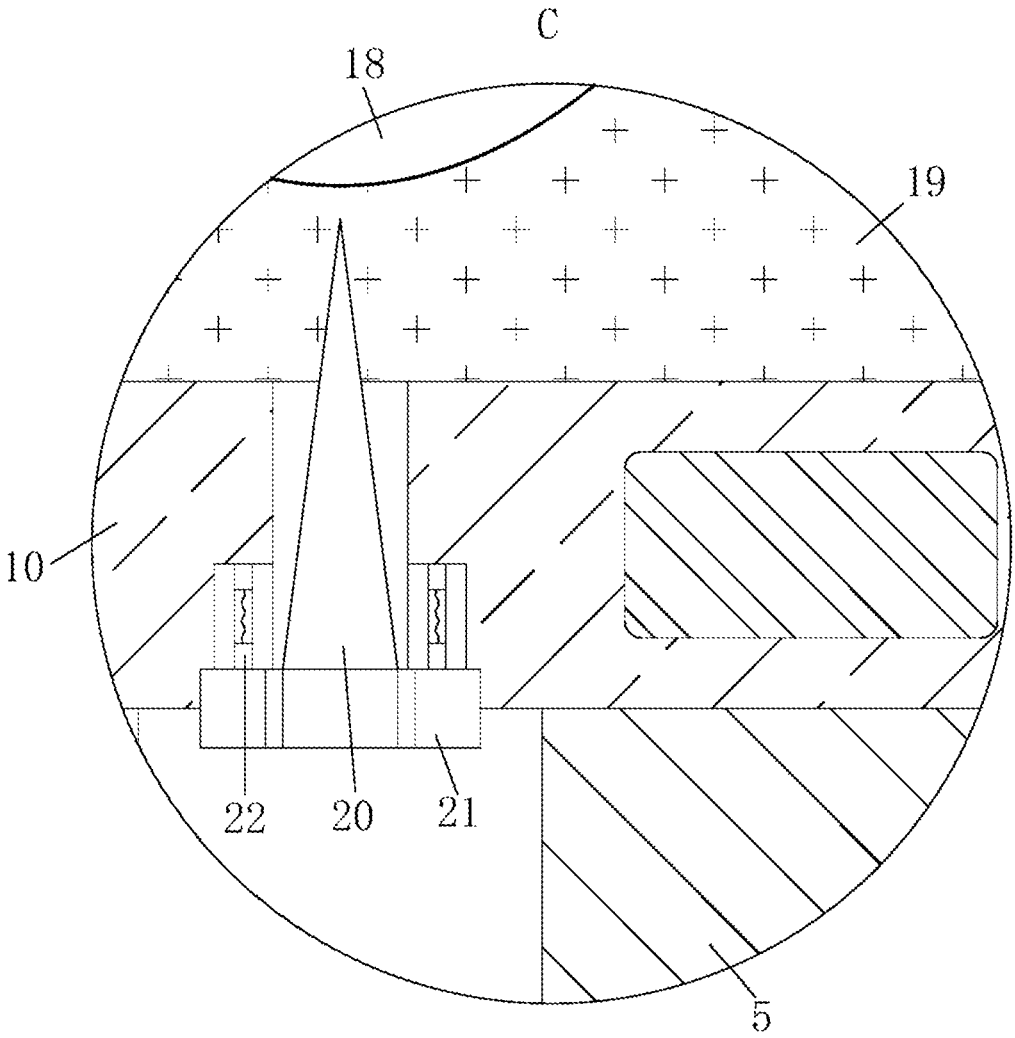
FIG. 6 illustrates a partial enlarged schematic diagram of a C portion in FIG. 4 according to the disclosure.

As shown in FIG. 6, a side of the liquid discharge hole 34 facing away from the buffer sponge 19 is slidably connected with a magnetic closing block 21, a plurality of telescopic rods 22 are fixed between the magnetic closing block 21 and the explosion-proof housing 10, and a side of the magnetic closing block 21 facing towards the buffer sponge 19 is provided with a telescopic needle 20. In the coal uncovering construction method for blasting large cross-section gas tunnels, after the counterweight block 12 drives the knocking needle 14 to break down the glass housing 18, the counterweight block 12 will sink to the bottom of the glass housing 18. During the above process, the magnetic force of the follow-up magnet 13 will act on the magnetic closing block 21, thereby driving the magnetic closing block 21 to compress the plurality of telescopic rods 22 and then push the telescopic needle 20 to move. It should be noted that the telescopic needle 20 is of telescopic type, and the telescopic needle 20 will also protrude and come into contact with the glass housing 18 under the action of the magnetic force, piercing the glass housing 18 and causing the glass housing 18 to break down, further ensuring the corrosive liquid flow normally during the destruction of the misfired detonators and improving the stability of misfire detonator destruction. It also should be noted that under normal conditions, the telescopic needle 20 will not come into contact with the glass housing 18 when the magnetic closing block 21 fully compresses the plurality of telescopic rods 22.

Figure 7:
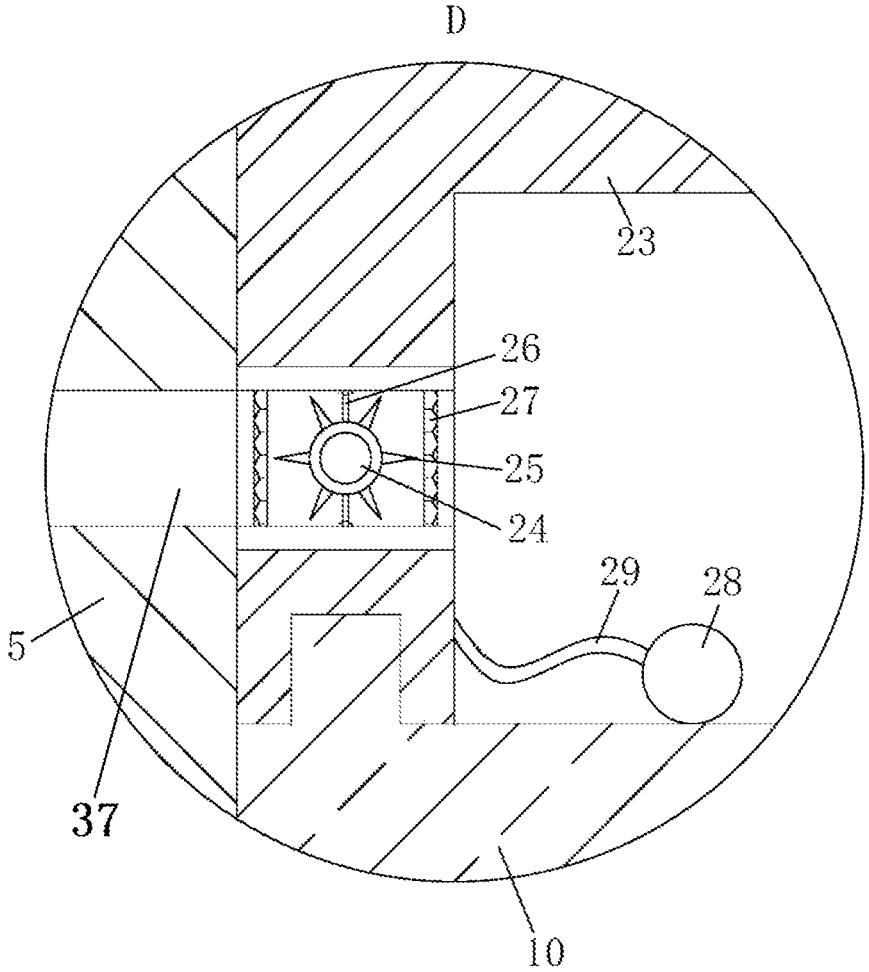
FIG. 7 illustrates a partial enlarged schematic diagram of a D portion in FIG. 4 according to the disclosure.

As shown in FIG. 7, a side of the explosion-proof housing 10 facing away from the corresponding adhesive plate 6 is inserted with a hollow column 23, the hollow column 23 is filled with a large amount of colored smoke and defines a plurality of exhaust vents 33, each of the plurality of exhaust vents 33 is provided with a counterweight ball 24 therein, an outer surface of the counterweight ball 24 is provided with a plurality of puncture needles 25, a supporting elastic rod 26 is fixed between the counterweight ball 24 and the hollow column 23, two sides of the counterweight ball 24 are provided with elastic films 27, and the corresponding extrusion rod 5 defines a plurality of through holes 37, which are matched with the plurality of exhaust vents 33. In the coal uncovering construction method for blasting large cross-section gas tunnels, structural components inside the explosion-proof housing 10 are mostly intact and reusable due to the protection of the explosion-proof housing 10. Furthermore, during the explosion of the detonator, the impact force generated will cause the counterweight ball 24 to drive the supporting elastic rod 26 to shake back and forth, thereby driving the plurality of puncture needles 25 to pierce the elastic films 27 caused by the shaking process of the counterweight ball 24, and then the colored smoke stored inside the hollow column 23 will escape after the elastic films 27 are pierced, which can effectively position the explosion-proof housing 10 and is convenient for recycling the explosion-proof housing 10 after the explosion, and then reducing searching time for the worker.

As shown in FIG. 7, the hollow column 23 is provided with a plurality of stirring balls 28 therein, and each of the plurality of stirring balls 28 is connected to the hollow column 23 through a connecting elastic rope 29. While constructing the tunnel, after the detonator explodes, each of the plurality of stirring balls 28 inside the hollow column 23 will pull the corresponding connecting elastic rope 29 to bounce back and forth under an action of inertia force, thereby stirring the colored smoke inside the hollow column 23 and preventing a precipitation of colored particles containing in the colored smoke from causing difficulties for the worker to find the explosion-proof housing 10.

Embodiment 2

Figure 8:
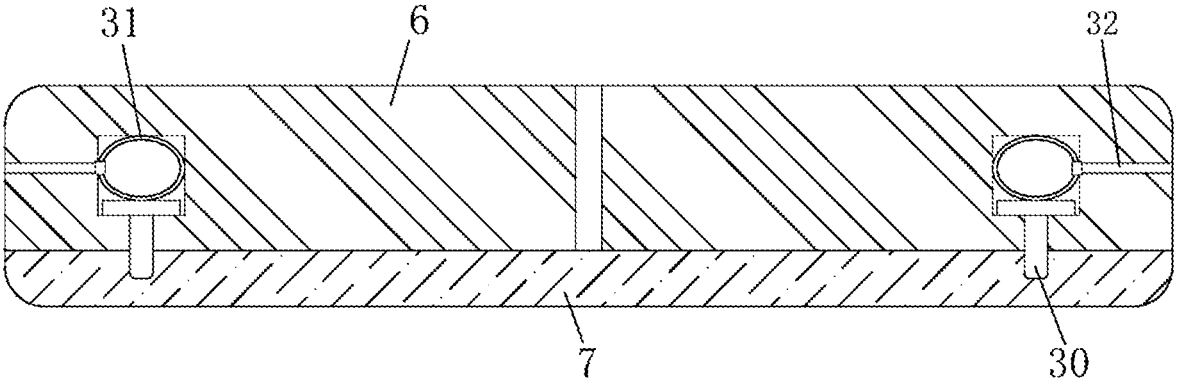
FIG. 8 illustrates a structural schematic diagram of an adhesive plate according to a second embodiment of the disclosure.
Figure 9:
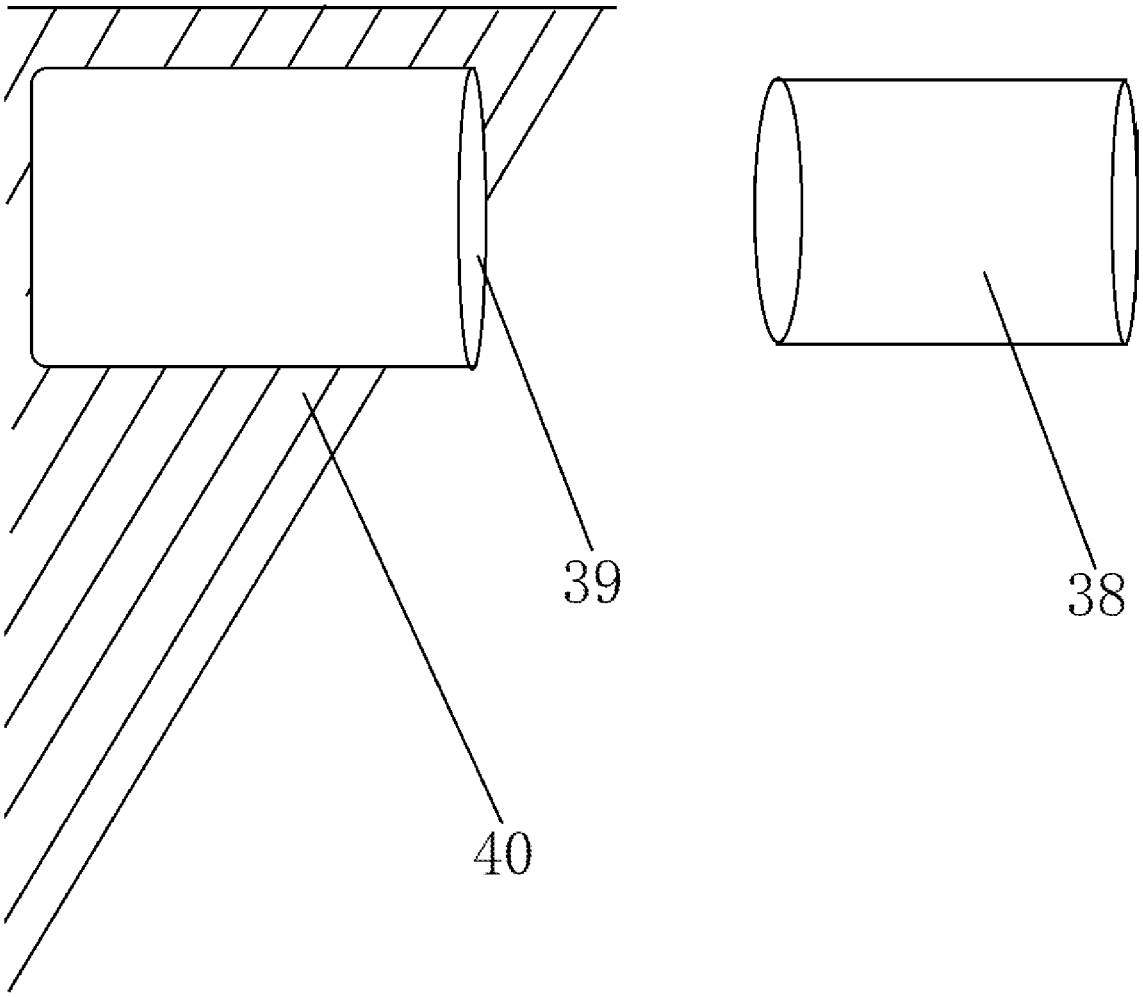
FIG. 9 illustrates a structural schematic diagram of an assembly relationship among a tunnel, a blast hole, and a detonator according to the disclosure.

As shown in FIG. 8, compared with the embodiment 1, another implementation mode of the disclosure is as follows: the adhesive plate 6 is slidably connected with a pair of jacking rods 30 therein, a side of each of the pair of jacking rods 30 facing away from the sponge mat 7 is provided with a powder storage bag 31, and a side of the powder storage bag 31 facing away from a center of the adhesive plate 6 is connected with a powder discharging pipe 32 in a penetrating manner. While constructing the tunnel, during the installation of the detonator, the adhesive plate 6 will drive the sponge mat 7 to gradually fit with the outer surface of the detonator. In the above process, the pair of jacking rods 30 will slide under an action of the outer surface of the detonator, thereafter to push and squeeze the powder storage bags 31 corresponding to the pair of jacking rods 30, and then to push and squeeze to spray dry powder inside the powder storage bags 31. The sprayed dry powder drips onto the outer surface of the detonator to keep the detonator's outer surface dry, thereby preventing a damp environment in the rock and soil from affecting the explosion of the detonator.

A working principle of the method is as follows: establishing the reserved rock wall model for uncovering coal in the gas outburst working area, and analyzing the stress state of the unit body in the limit equilibrium zone of the model, thereby to derive the formula for calculating the critical rock wall size to determine the thickness of the reserved rock wall, so that the thickness of the reserved rock wall is accurately determined, and the effect of effectively shortening the construction period for penetrating the coal measure strata while ensuring the tunnel boring safety.

When the thickness of the reserved rock wall is determined and the detonator is used for blasting, the worker needs to put the detonator into the fixed sand ring 1 first, and then push the plurality of extrusion rods 5 to drive the corresponding plurality of adhesive plates 6 to move until the plurality of adhesive plates 6 fit with the outer surface of the detonator, and then the detonator is fixed. At this time, the detonator is embedded into the blast hole excavated in advance, and the angle of the support foot 4 is adjusted to support the adjustable protective plate 3, thereby to support the detonator to ensure that the detonator does not deviate after being embedded, effectively ensuring the construction quality.

During the installation of the plurality of extrusion rods 5, the plurality of arc-shaped blocks 8 are driven to slide by pushing the plurality of extrusion rods 5. During the sliding process, the plurality of arc-shaped blocks 8 come into contact with the plurality of support elastic pieces 9, thereby pushing the plurality of support elastic pieces 9 to bend and deform until the plurality of arc-shaped blocks 8 completely slides over the plurality of support elastic pieces 9. When the plurality of arc-shaped blocks 8 slides over all of the plurality of support elastic pieces 9, the plurality of support elastic pieces 9 will reset, and then the plurality of arc-shaped blocks 8 are limited and the plurality of arc-shaped blocks 8 are prevented from resetting. Therefore, in this way, the plurality of arc-shaped blocks 8 can be effectively limited, thereby limiting the plurality of extrusion rods 5 and the corresponding adhesive plates 6, preventing the situation where the detonator slides out from the inner side of the fixed sand ring 1 after the detonator installation.

Under normal circumstances, the detonator can explode, causing the rock and soil to blast. However, some detonators may fail to explode due to internal faults, which can be called misfired detonators. Once the misfired detonators appear, caution should be taken and the safety of the worker should be the first priority. Some misfired detonators cannot be used again and need to be safely removed and destructed. At this time, the worker can remotely activate the switch signal of the energizing magnet 11 to enable it to operate, and then a repulsive force is applied to the follow-up magnet 13. At this time, the counterweight block 12 will push the knocking needle 14 to move under the repulsive force until the knocking needle 14 collides with the glass housing 18. When the knocking needle 14 collides with the glass housing 18, the glass housing 18 breaks down and the corrosion liquid stored inside leaks. The leaked corrosion liquid will drip onto the outer surface of the detonator through the liquid discharging hole 34, the through hole 35 of the extrusion rod 5, and the through hole 36 of the adhesive plate 6, and the through hole 35 of the extrusion rod 5 and the through hole 36 of the adhesive plate 6 are matched with the liquid discharge hole 34. Therefore, the detonator is corroded until the internal gunpowder is soaked, causing the inside gunpowder to completely fail. It should be noted that the entire corrosion process requires different time depending on the concentration of the corrosion liquid. The worker can only go to recycle and process the detonator within half an hour after the completion of the corrosion operation, so that the misfired detonators can be automatically destructed to protect the worker's safety.

After the detonator explodes normally, the fixed sand ring 1 will be decomposed by the impact force of the explosion, and the extrusion rods 5 also break down under the action of the explosion. At this time, the explosion-proof housing 10 can protect its internal structure from the damage caused by the impact force of the explosion. At this time, the elastic pieces 15 can support and limit the counterweight block 12 to prevent the counterweight block 12 from colliding with the glass housing 18 during the detonator explosion process. It should be noted that the repulsive force generated after the activation of the energizing magnet 11 should be sufficient to drive the counterweight block 12 to push the elastic pieces 15 to deform, thus achieving the effect of cyclic use. Furthermore, the design of the rubber ring 17 and the buffer sponge 19 can protect and limit the glass housing 18 during the rolling process of the explosion-proof housing 10 after detonator explosion, preventing the glass housing 18 from breaking down or coming into contact with the knocking needle 14.

After the counterweight block 12 drives the knocking needle 14 to break down the glass housing 18, it will sink to the bottom of the glass housing 18. During this process, the magnetic force of the follow-up magnet 13 can act on the magnetic closing block 21, which drives the magnetic closing block 21 to compress the telescopic rods 22 and push the telescopic needle 20 to move. It should be noted that the telescopic needle 20 is telescopic, so that at the same time, the telescopic needle 20 can also extend out and come into contact with the glass housing 18 under the action of the magnetic force, and then the glass housing 18 is punctured to break down, further ensuring the normal flow of the corrosive liquid during the misfired detonators destruction, and improving the stability of the misfired detonators destruction. It should be noted that under normal conditions, the magnetic closing block 21 fully compresses the telescopic rods 22, and the telescopic needle 20 cannot come into contact with the glass housing 18.

After the normal explosion of the detonator, the structural components inside the explosion-proof housing 10 are mostly intact and reusable due to the protection of the explosion-proof housing 10. During the explosion of the detonator, the impact force generated can cause the counterweight balls 24 to drive the corresponding supporting elastic rods 26 to shake back and forth. During the shaking process of the counterweight balls 24, each of the counterweight balls 24 can drive the corresponding plurality of puncture needles 25 to pierce the elastic films 27 disposed on the two sides of the counterweight ball 24. After the elastic films 27 are pierced, the colored smoke stored inside the hollow column 23 escapes, and then the position of the explosion-proof housing 10 can be positioned to facilitate the recycling and utilization after the explosion, reducing the search time for the worker. After the detonator explodes, the plurality of stirring balls 28 inside the hollow column 23 can pull the connecting elastic ropes 29 corresponding to the plurality of stirring balls 28 to bounce back and forth under the action of inertia force, thereby stirring the colored smoke inside the hollow column 23 and preventing the precipitation of colored particles containing in the smoke from causing difficulties for the worker to find.

During the installation of the detonator, the plurality of adhesive plates 6 can drive the corresponding plurality of sponge mats 7 to gradually fit with the outer surface of the detonator. During this process, the jacking rods 30 can slide under the action of the outer surface of the detonator, pushing and squeezing to spray the dry powder inside the powder storage bags 31. The sprayed dry powder can drip onto the outer surface of the detonator, keeping its surface dry and preventing the damp environment in the rock and soil from affecting the detonation of the detonator.

The foregoing terms of front, back, left, right, upper, and lower all refer to FIG. 1 in the attached drawings of the specification, which is determined according to observer's observation angle. Furthermore, the device facing the observer's side is determined as a standard, and the left side of the observer is determined as the left, and so on.

In the description of the disclosure, it should be understood that the orientation or positional relationship indicated by the terms "center", "longitudinal", "transverse", "front", "rear", "left", "right", "vertical", "horizontal", "top", "bottom", "outer", etc. is based on the orientation or positional relationship shown in the attached drawings, rather than indicating or implying that the indicated device or element must have a particular orientation, and is constructed and operated in a particular orientation, and therefore cannot be understood as a limitation to the scope of the protection of the disclosure.

The basic principles, main technical features, and advantages of the disclosure are shown and described above. It should be understood by those skilled in the related art that the disclosure is not limited by the foregoing embodiments, and the foregoing embodiments and the specification of the disclosure are merely used to illustrate the principles of the disclosure, and various changes and improvements may be made in the disclosure without departing from the spirit and scope of the disclosure, and these changes and improvements fall within the scope of the protection of the disclosure. The scope of the protection of the disclosure is defined by the written content of the disclosure and their equivalents.

What is claimed is:

1. A coal uncovering construction method for blasting a tunnel, comprising the following steps:

fixing a detonator through a fixed sand ring, embedding the detonator into the blast hole, and blasting the detonator for tunnel construction;

wherein an extension ring is fixed between the fixed sand ring and the protective plate, a bottom of the protective plate is rotatably connected with a support foot, an inner side of the fixed sand ring is connected with a plurality of extrusion rods, the plurality of extrusion rods are distributed in an array, an end of each of the plurality of extrusion rods facing towards a center of the fixed sand ring is fixedly connected to an adhesive plate, and a side of the adhesive plate facing away from the extrusion rod is connected to a sponge mat;

wherein an outer surface of each of the plurality of extrusion rods is provided with a plurality of arc-shaped blocks, exteriors of the plurality of arc-shaped blocks are slidably connected with a plurality of support elastic pieces, the plurality of support elastic pieces are connected with the fixed sand ring and are distributed in an array inside the fixed sand ring, and the plurality of arc-shaped blocks and the plurality of support elastic pieces are arc-shaped and each of the plurality of arc-shaped blocks is matched with a corresponding one of the plurality of support elastic pieces; and wherein each of the plurality of extrusion rods is provided with an explosion-proof housing therein, the explosion-proof housing is provided with an energizing magnet therein, a side of the energizing magnet facing towards the adhesive plate is provided with a counterweight block, the counterweight block is provided with a follow-up magnet therein;

when the energizing magnet is energized, a magnetic property of the energizing magnet is the same as that of the follow-up magnet, a side of the counterweight block facing away from the energizing magnet is provided with a knocking needle, a side of the knocking needle facing away from the energizing magnet is provided with a glass housing, the glass housing is loaded with corrosive liquid therein, a bottom end of the explosion-proof housing defines a liquid discharging hole, and the extrusion rod and the adhesive plate are respectively provided with through holes matched with the liquid discharging hole;

wherein the fixing the detonator through the fixed sand ring, comprises: placing the detonator into the fixed sand ring, pushing the plurality of extrusion rods to move the plurality of adhesive plates connected to the plurality of extrusion rods until the plurality of sponge mats connected to the plurality of adhesive plates are attached to an outer surface of the detonator; and wherein after the detonator is embedded into the blast hole, the coal uncovering construction method further comprises: adjusting an angle of the support foot to support the protective plate, thereby to support the detonator in the blast hole.

2. The coal uncovering construction method for blasting the tunnel as claimed in claim 1, wherein an exterior of the counterweight block is slidably connected with a limiting frame, the limiting frame is provided with elastic pieces therein disposed on two sides of the counterweight block, and the elastic pieces are configured to support the counterweight block.

3. The coal uncovering construction method for blasting the tunnel as claimed in claim 2, wherein an end of the limiting frame facing away from the energizing magnet is provided with a rubber ring, and a buffer sponge is disposed between an exterior of the glass housing and the explosion-proof housing.

4. The coal uncovering construction method for blasting the tunnel as claimed in claim 3, wherein a side of the liquid discharging hole facing away from the buffer sponge is slidably connected with a magnetic closing block, a plurality of telescopic rods are fixed between the magnetic closing block and the explosion-proof housing, and a side of the magnetic closing block facing towards the buffer sponge is provided with a telescopic needle.

5. The coal uncovering construction method for blasting the tunnel as claimed in claim 1, wherein a side of the explosion-proof housing facing away from the adhesive plate is inserted with a hollow column, the hollow column is filled with colored smoke and defines a plurality of exhaust vents, each of the plurality of exhaust vents is provided with a counterweight ball therein, an outer surface of the counterweight ball is provided with a plurality of puncture needles, a supporting elastic rod is fixed between the counterweight ball and the hollow column, two sides of the counterweight ball are provided with elastic films, and the extrusion rod defines a plurality of through holes, which are matched with the plurality of exhaust vents.

6. The coal uncovering construction method for blasting the tunnel as claimed in claim 5, wherein the hollow column is provided with a plurality of stirring balls therein, and each of the plurality of stirring balls is connected to the hollow column through a connecting elastic rope.

7. The coal uncovering construction method for blasting the tunnel as claimed in claim 1, wherein the adhesive plate is slidably connected with a pair of jacking rods therein, a side of each of the pair of jacking rods facing away from the sponge mat is provided with a powder storage bag, and a side of the powder storage bag facing away from a center of the adhesive plate is connected with a powder discharging pipe in a penetrating manner.

8. A coal uncovering construction method for blasting a tunnel, comprising the following steps:

providing an assembly for fixing a detonator, wherein the assembly comprises:

a fixed sand ring;

a protective plate;

an extension ring, fixed between the fixed sand ring and the protective plate;

a support foot, connected to a bottom of the protective plate;

a plurality of extrusion rods, connected to the fixed sand ring and extending into the fixed sand ring;

a plurality of arc-shaped blocks, disposed on an outer surface of each of the plurality of extrusion rods;

a plurality of support elastic pieces, disposed on the fixed sand ring, and matched with the plurality of arc-shaped blocks;

a plurality of adhesive plates, connected to ends of the plurality of extrusion rods facing towards a center of the fixed sand ring, respectively; and a plurality of sponge mats, connected to sides of the plurality of adhesive plates facing away from the plurality of extrusion rods, respectively;

placing the detonator into the fixed sand ring, pushing the plurality of extrusion rods to drive the plurality of adhesive plates to move towards the detonator until the plurality of sponge mats are attached to an outer surface of the detonator to fix the detonator in the fixed sand ring; wherein each of the plurality of extrusion rods is pushed to drive the plurality of arc-shaped blocks to slide, thereby to push the plurality of support elastic pieces to bend and deform until the plurality of arc-shaped blocks slide over the plurality of support elastic pieces, and then the plurality of support elastic pieces reset; and embedding the detonator fixed with the fixed sand ring into a blast hole excavated in the tunnel, adjusting an angle of the support foot to support the protective plate, and thereby to support the detonator in the blast hole, thereafter blasting the detonator in the blast hole for tunnel construction.

9. The coal uncovering construction method for blasting the tunnel as claimed in claim 8, wherein the assembly further comprises:

a plurality of explosion-proof housings, disposed in the plurality of extrusion rods, respectively; wherein a bottom end of each of the plurality of explosion-proof housings defines a liquid discharging hole, and each of the plurality of extrusion rods and the plurality of adhesive plates is provided with a through hole matched with the liquid discharging hole;

a plurality of energizing magnets, disposed in the plurality of explosion-proof housings, respectively;

a plurality of counterweight blocks, disposed on sides of the plurality of energizing magnets facing towards the plurality of adhesive plates, respectively;

a plurality of follow-up magnets, disposed in the plurality of counterweight blocks, respectively; wherein a magnetic property of the plurality of energizing magnets after being energized is same as a magnetic property of the plurality of follow-up magnets;

a plurality of knocking needles, disposed on sides of the plurality of counterweight blocks facing away from the plurality of energizing magnets, respectively; and a plurality of glass housings, disposed at sides of the plurality of knocking needles facing away from the plurality of energizing magnets, respectively;

wherein the coal uncovering construction method further comprises:

energizing the plurality of energizing magnets to exert repulsive forces on the plurality of follow-up magnets when the detonator fails to blast, thereby to drive the plurality of counterweight blocks to move with the plurality of knocking needles until the plurality of knocking needles collide with the plurality of glass housings and break down the plurality of glass housings to discharge corrosive liquid loaded within the plurality of glass housings onto the outer surface of the detonator through the liquid discharging holes and the through holes, thereby to corrode the detonator.

10. The coal uncovering construction method for blasting the tunnel as claimed in claim 9, wherein the assembly further comprises:

a hollow column filled with colored smoke, disposed on a side of each of the plurality of explosion-proof housings facing away from the corresponding adhesive plate; wherein the hollow column defines a plurality of exhaust vents;

a counterweight ball, disposed in each of the plurality of exhaust vents;

a plurality of puncture needles, disposed on an outer surface of each counterweight ball;

a supporting elastic rod, fixed between the counterweight ball and the hollow column;

elastic films, disposed on two sides of the counterweight ball; wherein each extrusion rod defines a plurality of through holes matched with the plurality of exhaust vents, respectively; and wherein the coal uncovering construction method further comprises:

driving the counterweight ball to shake the supporting elastic rod under an impact force generated by blasting the detonator, thereby driving the plurality of puncture needles to pierce the elastic films, and escaping the colored smoke stored inside the hollow column after the elastic films are pierced.

* * * * *